US012495864B2

(12) United States Patent
Sadler et al.

(10) Patent No.: US 12,495,864 B2
(45) Date of Patent: Dec. 16, 2025

(54) SNAP-ON CLOG-STYLE SHOE LINER AND METHOD OF USE

(71) Applicants: Kaitlin Sadler, Mooresville, NC (US); Jason Sadler, Mooresville, NC (US)

(72) Inventors: Kaitlin Sadler, Mooresville, NC (US); Jason Sadler, Mooresville, NC (US)

( * ) Notice: Subject to any disclaimer, the term of this patent is extended or adjusted under 35 U.S.C. 154(b) by 0 days.

(21) Appl. No.: 18/607,805

(22) Filed: Mar. 18, 2024

(65) Prior Publication Data

US 2024/0315395 A1 Sep. 26, 2024

Related U.S. Application Data

(60) Provisional application No. 63/491,545, filed on Mar. 22, 2023.

(51) Int. Cl.
*A43B 19/00* (2006.01)
*A43B 17/18* (2006.01)

(52) U.S. Cl.
CPC ..... *A43B 19/00* (2013.01); *A43B 17/18* (2013.01)

(58) Field of Classification Search
None
See application file for complete search history.

(56) References Cited

U.S. PATENT DOCUMENTS 1,336,243 A * 4/1920 Lee ..... A44B 3/08 24/108
1,392,350 A * 10/1921 O'Brien ..... A43B 7/08 36/3 A
1,803,554 A * 5/1931 Knilans ..... A43B 5/00 36/114
2,748,517 A * 6/1956 Berkis ..... A41D 27/08 446/28
4,132,016 A * 1/1979 Vaccari ..... A43B 19/00 36/114
4,736,531 A * 4/1988 Richard ..... A43B 23/087 36/31
6,877,252 B2 * 4/2005 Wilkinson ..... A43B 3/12 36/105
6,952,891 B2 10/2005 Hirayama
7,370,438 B2 5/2008 Vattes
7,591,084 B2 * 9/2009 Santa Ana ..... A43B 3/0047 36/15
7,810,257 B2 * 10/2010 Candrian ..... A43B 7/1495 36/15

(Continued)

*Primary Examiner* — Jila M Mohandesi
(74) *Attorney, Agent, or Firm* — Brennan, Manna & Diamond, LLC

(57) ABSTRACT

A protective liner designed for use with clog shoes and Crocs™-style shoes. The liner comprises a waterproof outer layer and a soft and fuzzy inner layer that are adhered to each other, with both layers having similar dimensions. In one embodiment, the liner has a footbed functioning as an insole and an upper foot covering portion designed to cover the top portion of the foot. Additionally, the liner has a pair of studs disposed on the upper foot covering portion, which extend out of two ventilator holes of a plurality of ventilator holes disposed in the Crocs™-style shoe. A pair of securement buttons are used for releasably fastening to the studs to secure the liner to the shoe. In another embodiment, the liner does not have a footbed. The protective liner covers the foot of a user for protecting from weather elements while wearing the Crocs™-style shoe.

14 Claims, 6 Drawing Sheets

(56) References Cited

U.S. PATENT DOCUMENTS

| | | | | |
|---|---|---|---|---|
| 8,069,538 | B2 * | 12/2011 | Wilcox | A43C 1/00 24/628 |
| 8,196,320 | B2 * | 6/2012 | Adami | A43B 5/02 36/133 |
| 8,782,814 | B2 * | 7/2014 | Schmelzer | A44B 1/32 63/23 |
| 8,991,071 | B2 * | 3/2015 | Bathum | A43B 1/0027 36/11.5 |
| 9,839,259 | B2 | 12/2017 | Arquilla | |
| 11,129,442 | B2 * | 9/2021 | Arquilla | A43B 19/00 |
| 2004/0128863 | A1 * | 7/2004 | Hong | A43B 13/12 36/55 |
| 2004/0244221 | A1 | 12/2004 | Hall | |
| 2005/0172516 | A1 * | 8/2005 | Dalbec | A43B 3/244 36/11.5 |
| 2008/0168681 | A1 * | 7/2008 | Andersen | A43B 13/12 36/15 |
| 2009/0100713 | A1 * | 4/2009 | Adami | A43B 5/02 36/133 |
| 2014/0178627 | A1 | 6/2014 | Baychar | |
| 2017/0027272 | A1 * | 2/2017 | Yeglinski, II | A43B 17/003 |

* cited by examiner

SNAP-ON CLOG-STYLE SHOE LINER AND METHOD OF USE

CROSS-REFERENCE TO RELATED APPLICATION

The present application claims priority to, and the benefit of, U.S. Provisional Application No. 63/491,545, which was filed on Mar. 22, 2023 and is incorporated herein by reference in its entirety.

FIELD OF THE INVENTION

The present invention relates generally to the field of footwear liners. More specifically, the present invention relates to a novel protective liner for Crocs™-style or clog style footwears. The liner is reusable and adheres to the inner surface of the Crocs™-style or clog style footwear and has a pair of studs and buttons for fastening the liner to the footwear, thereby prevent slippage of the liner during use. The liner comes in two embodiments, one embodiment covering the front half of the foot and a second embodiment covering the entire foot, from toe to heel. Accordingly, the present disclosure makes specific reference thereto. Nonetheless, it is to be appreciated that aspects of the present invention are also equally applicable to other like applications, devices, and methods of manufacture.

BACKGROUND

By way of background, Crocs™-style shoes, also known as clogs, are a type of casual footwear that is made of a lightweight and durable foam resin material (i.e., ethylene vinyl acetate (EVA)). Clogs and Crocs™-style footwear have become increasingly popular over the past couple of decades. The unique design of these shoes features numerous holes on the top which act as ventilator holes and water exit ports, making the footwear perfect for wearing in warm temperatures and/or warm water environments. Such footwears are also known for their comfort and durability, making them a popular choice for people of all ages.

Despite their popularity, one major drawback of clogs is that they are not suitable for cold temperatures and cold rainy seasons. The holes on the top of the shoe allow cold air and cold water to enter, which can be exceptionally uncomfortable for the wearer. This can be especially frustrating for those who want to wear their clogs indoors during the colder months or while outside during the winter. During rain, feet of users wearing clogs get wet which is annoying and troublesome. Therefore, people desire a means to protect their feet from weather elements and/or cold water while wearing clogs.

Generally, liners are used with conventional footwears for additional support and protection from weather elements, but such liners are incompatible with Crocs™-style and clog style footwears because of unique design of the clogs. Continuously wearing socks and storing socks in clogs while not wearing is not easy and effective. As a result, there is a need of an improved liner that can be used with Crocs™-style and clog style shoes.

A common problem with conventional footwear liners is that they slip during use and can get wet. As a result, a wearer is required to repeatedly adjust the liners which is inconvenient. Further, such liners are not comfortable during use as well. People desire a new liner that can be effectively locked and fastened to a footwear for effective use.

Therefore, there exists a long felt need in the art for a footwear liner designed especially for Crocs™-style or clog style footwear. There is also a long felt need in the art for a liner that can be easily used with Crocs™-style and clog style footwears for providing comfort. Additionally, there is a long felt need in the art for a Crocs™-style and clog style footwear liner that protects feet of a user from cold and other weather elements. Moreover, there is a long felt need in the art for a liner that can releasably and readily fastened to a Crocs™-style footwear. Further, there is a long felt need in the art for a Crocs™-style footwear liner that can be reused and does not slip during use. Furthermore, there is a long felt need in the art for a liner that covers feet of a user and protects from cold and liquids. Finally, there is a long felt need in the art for a liner that improves warmth and comfort when wearing clogs in all types of weather.

The subject matter disclosed and claimed herein, in one embodiment thereof, comprises a protective liner for a Crocs™-style shoe. The liner is designed to cover a foot, or a portion of a foot, of a user for protecting from weather elements while wearing the Crocs™-style shoe. The liner features a waterproof outer layer, a soft and fuzzy inner layer, the inner layer and the outer layer are of similar dimensions and are adhered to each other. The liner has a footbed functioning as an insole and an upper foot covering portion designed to cover a top portion of the foot, a pair of studs disposed on the upper foot covering portion, the pair of studs extend out of two ventilator holes from a plurality of ventilator holes disposed in the Crocs™-style shoe, and a pair of securement buttons for releasably fastening to the studs to secure the liner to the shoe. In another embodiment, the liner does not have the footbed.

In this manner, the Crocs™-style shoe liner of the present invention accomplishes all of the forgoing objectives and provides users with a multipurpose liner for Crocs™-style footwear. The liner improves warmth and comfort when wearing clogs, allowing users to place the liner within the shoe and wear them during both warm and cold weather conditions. The liner utilizes small buttons and fasteners to secure them to the footwear through the holes or ventilator holes on the top of Crocs™-style shoes.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a reusable liner for a Crocs™-style shoe. The liner is designed to cover a foot of a user while wearing the Crocs™-style shoe. The liner further comprising a waterproof outer layer, a soft and fuzzy inner layer, the inner layer and the outer layer form a unitary structure. Structurally, the liner has a footbed and an upper foot covering portion, the upper foot covering portion designed to cover a top portion of the foot, a pair of studs disposed on the upper foot covering portion, the pair of studs designed to extend out of two ventilator holes of a plurality of ventilator holes disposed in the Crocs™-style shoe, and a pair of securement buttons that can be releasably fastened to the studs to secure the liner to the shoe and prevent slipping or movement of the liner inside the shoe. The liner includes a toe region or portion that covers the toes and a heel region or portion that covers the heel portion of the wearer.

In yet another embodiment, the material used for the inner layer comprises a thin foam layer, such as 1-3 mm of low-density, open cell foam or memory foam, to provide enhanced padding.

In yet another embodiment, the outer layer does not permeate when liquid materials are spilled on it, providing an advantage to users to keep their feet dry.

In yet another embodiment, a multipurpose Crocs™ or clog liner for use with a Crocs™-style shoe is disclosed. The Crocs™ or clog liner comprising a waterproof outer layer and a soft and fuzzy inner layer, the outer layer and the inner layer having similar shape and dimensions and being adhered to each other for providing a unitary structure to the liner, the liner having a footbed for supporting a foot of a user and an upper foot covering portion for covering a top portion of the foot of the user, the foot covering portion having a pair of studs disposed thereon such that the studs extend through and out of two ventilator holes from a plurality of ventilator holes disposed in a Crocs™-style shoe, and a pair of buttons, each button corresponding to a stud of the pair of studs, provided such that the buttons can be releasably fastened to the studs, thereby securing the liner and eliminating slipping or movement of the liner inside the shoe. The buttons are placed on the studs from the top of the shoe to fasten to the projecting studs.

In yet another embodiment, the foot covering portion of the liner covers the ventilator holes of the upper section and thereby protects the foot of a user from sun, rain, snow, dirt, and other weather elements.

In yet another embodiment, a reusable liner for a Crocs™-style shoe is disclosed. The liner comprising a foot covering portion configured to cover only the front half of a user's foot, the foot covering portion having a waterproof outer layer and a soft and comforting inner layer, and a pair of studs positioned on the outer layer of the foot covering portion for securing the liner to the Crocs™-style shoe wherein a pair of snap-on buttons are fastened to the studs, the liner conforming to the shape and size of conventional Crocs™-style shoes.

In yet another embodiment, a method of using a Crocs™ or clog liner in a Crocs™-style shoe is described. The method includes the steps of positioning the foot covering portion of the liner in the front half of the shoe, adhering the toe region or portion, and curved distal end of the liner to the shoe, securing the liner to the shoe with a pair of studs and a pair of securement buttons, and detaching the liner from the shoe when desired.

In yet another embodiment, a method for securing a Crocs™ or clog liner to a Crocs™-type shoe using snap-on buttons is described. The method includes the steps of inserting the Crocs™ or clog liner into the shoe such that the foot top surface covering portion of the liner adheres to the upper portion of the Crocs™-shoe, extending a pair of studs disposed on the foot top surface covering portion of the liner from ventilator holes of the Crocs™-shoe, securing the liner by fastening a pair of snap-on buttons to the studs, wherein the snap-on buttons are positioned from the outside of the upper portion of the shoe.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
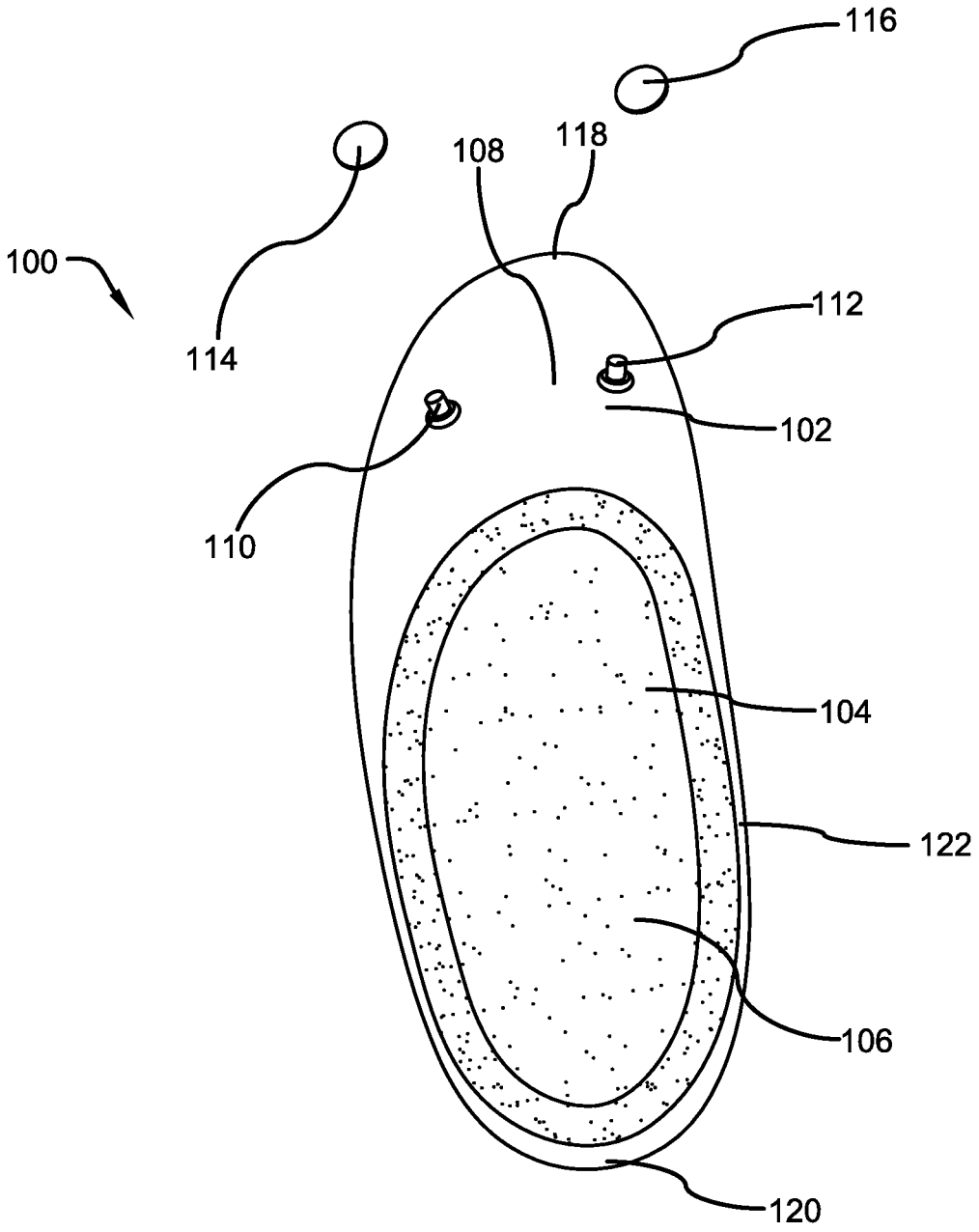
FIG. 1 illustrates a perspective view of one potential embodiment of a multipurpose Crocs™ or clog liner of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a footwear liner designed especially for Crocs™-style footwear. There is also a long felt need in the art for a liner that can be easily used with Crocs™-style footwears for providing comfort. Additionally, there is a long felt need in the art for a Crocs™-style footwear liner that protects feet of a user from cold and other weather elements. Moreover, there is a long felt need in the art for a liner that can releasably fasten to a Crocs™-style footwear. Further, there is a long felt need in the art for a Crocs™-style footwear liner that can be reused and does not slip during use. Furthermore, there is a long felt need in the art for a liner that covers feet of a user and protects from cold and liquids. Finally, there is a long felt need in the art for a liner that improves warmth and comfort when wearing clogs in all types of weather.

The present invention, in one exemplary embodiment, is a method for securing a Crocs™ or clog liner to a Crocs™-type shoe using snap-on buttons. The method includes the steps of inserting the Crocs™ or clog liner into the shoe such that the foot top surface covering portion of the liner adheres to the upper portion of the Crocs™-shoe, extending a pair of studs disposed on the foot top surface covering portion of the liner through ventilator holes of the Crocs™-shoe, securing the liner by fastening a pair of snap-on buttons to the studs, wherein the snap-on buttons are positioned from the outside of the upper portion of the shoe.

Referring initially to the drawings, FIG. 1 illustrates a perspective view of one potential embodiment of a multi-purpose Crocs™ or clog liner of the present invention in accordance with the disclosed architecture. The multipurpose Crocs™ or clog liner 100 of the present invention is designed as a reusable Crocs™ or clog liner for removably snapping into an existing Crocs™-style shoe, thereby providing comfort to a wearer. More specifically, the liner 100 is designed to fit in a Crocs™-style shoe and has a waterproof outer layer 102 and soft and fuzzy inner layer 104. The outer layer 102 and the inner layer 104 have similar shapes and dimensions and are adhered to each other for providing a unitary structure to the liner 100. In the present embodiment, the liner 100 has a footbed 106 for supporting a foot of a user and an upper foot covering portion 108 for covering a top portion of the foot of the user. The foot covering portion 108 has a pair of studs 110, 112 disposed thereon such that the studs 110, 112 extend through and out of two ventilator holes from a plurality of ventilator holes disposed in a Crocs™-style shoe. The studs 110, 112 are especially positioned such that they do not abut against the clogs surface.

Figure 2:
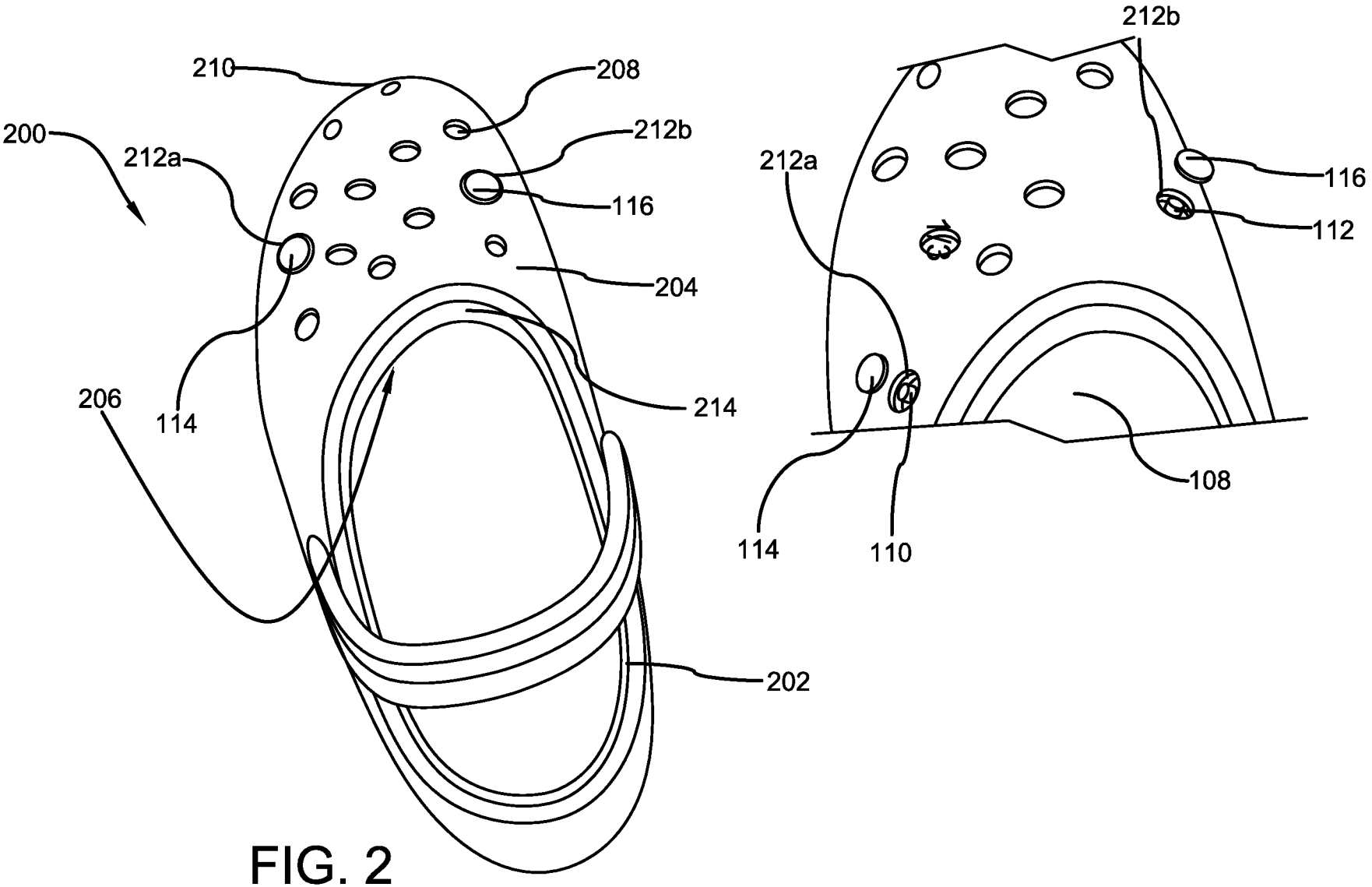
FIG. 2 illustrates a perspective view showing the Crocs™-style shoe liner of FIG. 1 applied to a Crocs™-style shoe for use in accordance with the disclosed architecture.

For securing the liner 100 to a Crocs™-style shoe, a pair of buttons (i.e., snaps) or fasteners 114, 116, each button, snap, or fastener corresponding to a stud of the pair of studs 110, 112 is provided such that the buttons 114, 116 can be releasably fastened to the studs 110, 112, thereby securing the liner 100 and thus eliminating slipping or movement of the liner 100 inside the shoe as illustrated in FIG. 2. The liner 100 is designed to cover an entire foot, or a majority of the foot, of a wearer, with a toe region or portion 118 covering the toe area and a heel region/portion or distal end 120 configured to cover a heel portion of the wearer. The toe region or portion 118 can be tapered such that it generally follows the contour of a human foot where larger toes exist at the inside of the foot, and the foot tapers to smaller toes on the outside. In other embodiments, toc region 118 is a square cross section that does not exhibit tapering, while yet other embodiments provide a rounded square. The liner 100 provides a comfortable and snug fit that prevents cold air or water from entering the shoe and keeps the feet dry and warm. The sidewall 122 of the liner 100 is configured to conform to the shape of the wearer's foot.

The material used for the liner 100 is both waterproof and breathable, making it comfortable to wear for extended periods. The waterproof outer layer 102 ensures that the feet stay dry even in wet conditions, while the soft and fuzzy inner layer 104 provides additional comfort and warmth. In some embodiments, a thin foam layer, such as 1-3 mm of low-density, open cell foam or memory foam, can also be used as a backing to provide enhanced padding in the inner layer 104. The liner 100 is also reusable and can be easily cleaned and maintained. The dimensions of the liner 100 are specifically designed to fit inside a Crocs™-style shoe, making it an ideal accessory for anyone who owns such shoes. The liner 100 is available in different sizes to fit different foot sizes and shapes. The outer layer 102 does not permeate when liquid materials spilled thereon or when a wearer steps in water thereby providing advantages to users to keep their feet dry.

FIG. 2 illustrates a perspective view showing the Crocs™-style shoe liner of FIG. 1 applied to a Crocs™-style shoe for use in accordance with the disclosed architecture. As illustrated, the exemplary Crocs™-style shoe 200 is like any conventional Crocs™-shoe and has an insole/base 202 for supporting feet and an upper section 204 having a plurality of ventilator holes 208. The ventilator holes 208 can be, but are not limited to, openings for providing air passage. A toe end 210 is positioned for surrounding toes of a human foot. In use, the liner 100 of the footbed 106 is set upon the base 202 such that the foot covering portion 108 adheres to inner surface 206 of the upper section 204. The toe region 118 of the liner 100 adheres to the toe end 210 of the shoe 200 with the buttons 114, 116 fastened to the studs 110, 112 projecting from the ventilator holes 212*a*, 212*b* (a part of plurality of ventilator holes 208) disposed on the upper section 206.

The foot covering portion 108 covers the ventilator holes 208 and thereby protects the foot of a user from sun, rain, snow, dirt, and other weather elements. The liner 100 also provides comfort to feet and can be easily removed by unfastening the buttons 114, 116 from the studs 110, 112.

Figure 3:
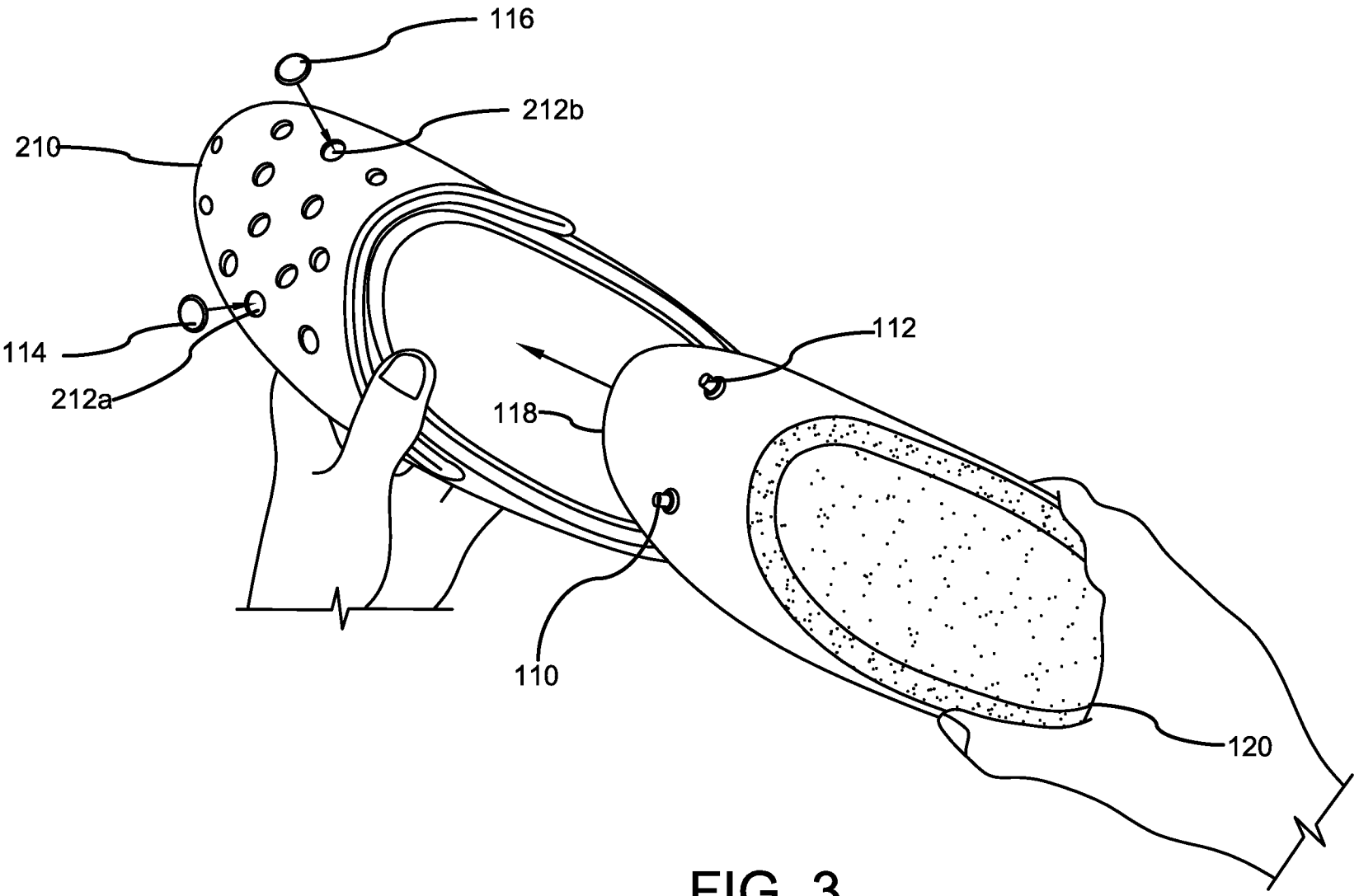
FIG. 3 illustrates a perspective view showing the Crocs™-shoe liner of FIG. 1 being inserted inside the Crocs™-type shoe for use in accordance with the disclosed architecture.

FIG. 3 illustrates a perspective view showing the Crocs™-shoe liner of FIG. 1 being inserted inside the Crocs™-type shoe for use in accordance with the disclosed architecture. For positioning the liner 100 inside the shoe 200, the liner 100 is held using the distal end 120 while toe region 118 of the liner 100 is inserted inside the shoe 200 till the toe region 118 adheres to the toe end 210 of the shoe 200. Then, the studs 110, 112 are automatically aligned with the ventilator holes 212*a*, 212*b* enabling a user to fasten the buttons 114, 116 as illustrated in FIG. 2.

Figure 4:
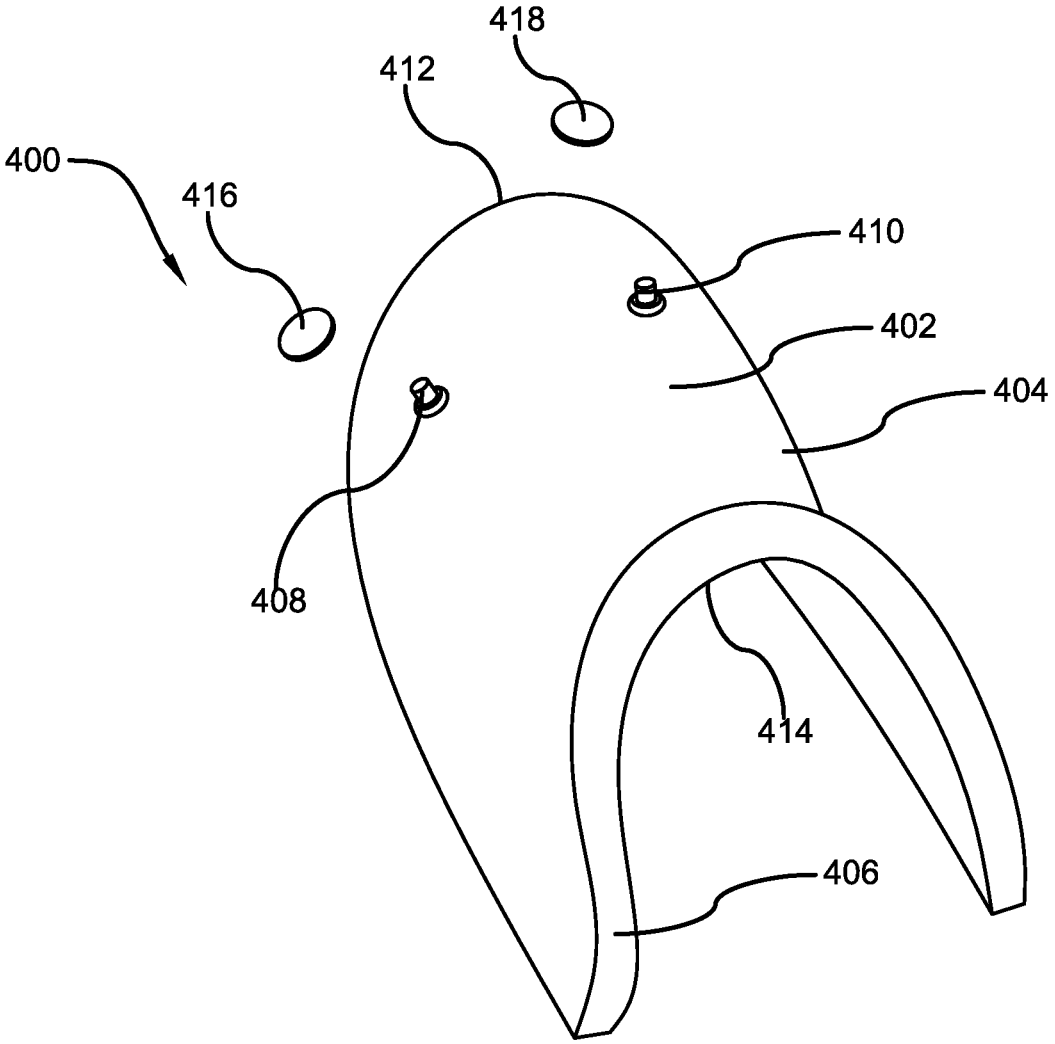
FIG. 4 illustrates a perspective view showing another embodiment of the Crocs™ or clog liner of the present invention in accordance with the disclosed architecture.
Figure 5:
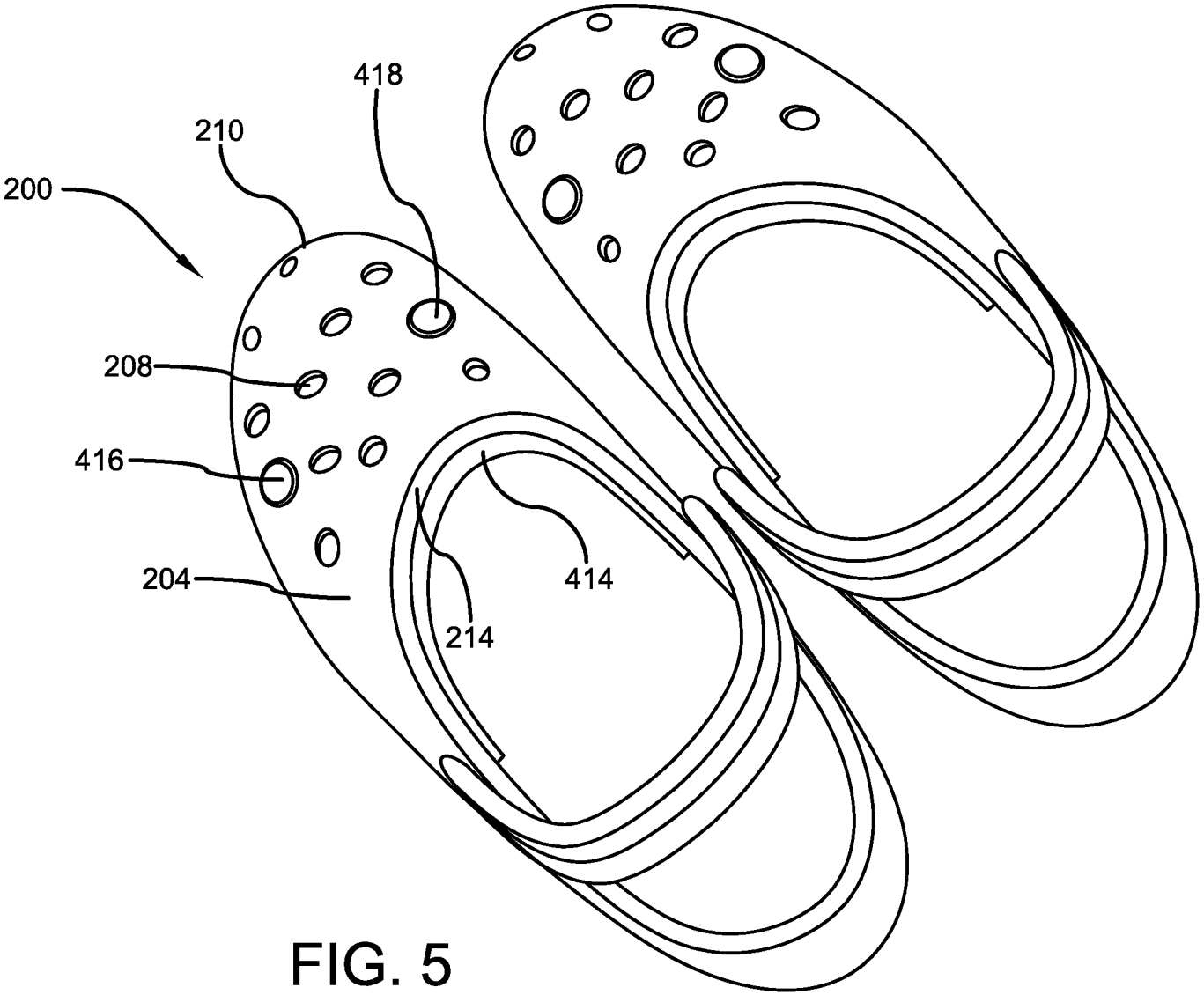
FIG. 5 illustrates a perspective view showing the Crocs™ or clog liner of FIG. 4 positioned in a Crocs™ shoe for use in accordance with the disclosed architecture.

FIG. 4 illustrates a perspective view showing another embodiment of the Crocs™ or clog liner of the present invention in accordance with the disclosed architecture. As illustrated, in the present embodiment, the Crocs™ or clog liner 400 is designed to cover front half of a foot of a user when positioned in a Crocs™ shoe. More specifically, the liner 400 does not have a footbed portion and only contains a front foot covering portion 402. Similar to other embodiments, the liner 400 has a waterproof outer layer 404 and a soft and comforting inner layer 406. A pair of studs 408, 410 are positioned on the outer layer 404 of the foot covering portion 402 for securing the liner 400 to a Crocs™ shoe as illustrated in FIG. 5. The liner 400 conforms to the shape and size of conventional Crocs™ shoes and can be detachably used with the Crocs™ shoe. A toe region or portion 412 and a curved distal end 414 are configured to adhere to a Crocs™-shoe for secure attachment without slippage and discomfort to a user.

FIG. 5 illustrates a perspective view showing the Crocs™ or clog liner of FIG. 4 positioned in a Crocs™ shoe for use in accordance with the disclosed architecture. The Crocs™ clog liner 400 is positioned inside the Crocs™ shoe 200 such that the foot covering portion 402 conforms and adheres to the upper portion 204 of the shoe 200 which has a plurality of ventilator holes 208. The toe region or portion 412 touches the toe end 210 and the curved distal end 414 conforms to the curved opening line 214 of the shoe 200. For securing the liner 400, the studs 408, 410 projecting through or from the ventilator holes 212*a*, 212*b* are fastened by securement buttons 416, 418. The foot covering portion 402, therefore, covers all the ventilator holes 208 and thus protects the foot of a user from weather elements allowing a user to wear the Crocs™ shoe 200 during all weather conditions.

Figure 6:
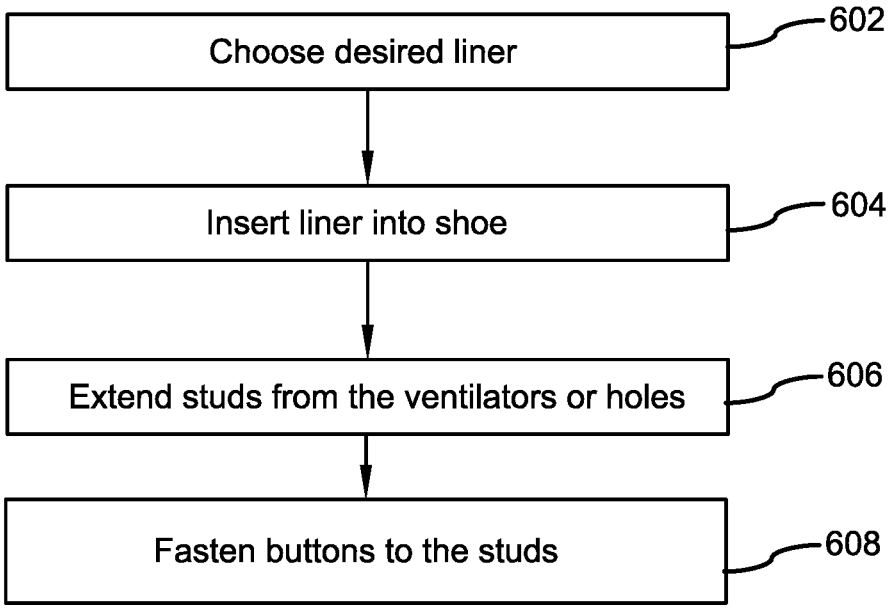
FIG. 6 illustrates a flow chart depicting a process of using the Crocs™ or clog liner of different embodiments of the present invention for protecting feet in accordance with the disclosed architecture.

FIG. 6 illustrates a flow chart depicting a process of using the Crocs™ or clog liner of different embodiments of the present invention for protecting feet in accordance with the disclosed architecture. Initially, a desired Crocs™ or clog liner is chosen and held in a hand in same orientation as of a Crocs™-type shoe (Step 602). Then, the Crocs™ or clog liner is inserted into the shoe such that the foot top surface covering portion adheres to the upper portion of the Crocs™-shoe and toc region of the Crocs™ or clog liner touches the toe end of the shoe (Step 604). Thereafter, the studs extend out of the two ventilator holes of the shoe such that they are accessible from outside of the upper portion of the Crocs™-shoe (Step 606). Finally, the Crocs™ or clog liner is secured by fastening the snap-on buttons to the studs wherein the snap-on buttons are positioned from the outside of the upper portion of the shoe (Step 608).

The liner can be removed for cleaning and can be replaced with new Crocs™ or clog liner. The Crocs™ or clog liners of different embodiments can come in different sizes, colors, designs and fabrics. Further, the Crocs™ or clog liners are machine washable and reusable and can be worn by people of all ages and genders.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "Crocs™ or clog liner", "multipurpose Crocs™ or clog liner", "liner", "Crocs™-style shoes liner", and "snap-on Crocs™-style shoe liner" are interchangeable and refer to the multipurpose snap-on Crocs™-style shoe liner 100, 400 of the present invention.

Notwithstanding the forgoing, the multipurpose snap-on Crocs™-style shoe liner 100, 400 of the present invention can be of any suitable size and configuration as is known in the art without affecting the overall concept of the invention, provided that it accomplishes the above stated objectives. One of ordinary skill in the art will appreciate that the multipurpose snap-on Crocs™-style shoe liner 100, 400 as shown in the FIGS. are for illustrative purposes only, and that many other sizes and shapes of the multipurpose snap-on Crocs™-style shoe liner 100, 400 are well within the scope of the present disclosure. Although the dimensions of the multipurpose snap-on Crocs™-style shoe liner 100, 400 are important design parameters for user convenience, the multipurpose snap-on Crocs™-style shoe liner 100, 400 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A multipurpose clog shoe liner comprising:

a clog shoe liner for removably snapping into an existing clog shoe;

a plurality of ventilator holes;

wherein said clog shoe liner having a waterproof outer layer and a soft inner layer;

wherein said outer layer and said soft inner layer having similar shapes and dimensions including a toe portion and a heel portion;

wherein said outer layer and said soft inner layer adhered to each other for providing a unitary structure to said clog shoe liner;

wherein said clog shoe liner having a footbed and said heel portion for supporting a foot of a user and an upper foot covering portion for covering a top portion of the foot of the user;

wherein said upper foot covering portion having at least two studs disposed thereon extending through existing ventilator holes in the existing clog shoe; and a pair of fasteners attached to said at least two studs for securing said clog shoe liner to the clog shoe; and wherein the pair of fasteners are each configured to releasably attach to the respective stud once penetrating the respective existing ventilator holes in the existing clog shoe from the outside of the existing clog shoe.

2. The multipurpose clog shoe liner of claim 1, wherein said clog shoe liner covering a majority of the foot of a wearer and lining an entire front area of the clog shoe.

3. The multipurpose clog shoe liner of claim 2, wherein said inner layer having a thin foam layer including a thickness from 1 mm to 3 mm.

4. The multipurpose clog shoe liner of claim 3, wherein said thin foam layer is selected from a group consisting of a low-density foam, an open cell foam, and a memory foam.

5. The multipurpose clog shoe liner of claim 4, wherein said clog shoe liner is removable from the clog shoe.

6. The multipurpose clog shoe liner of claim 5, wherein said clog shoe liner is washable.

7. A multipurpose clog shoe liner comprising:

a clog shoe liner for removably snapping into an existing clog shoe, wherein said clog shoe liner is reusable;

a plurality of ventilator holes;

wherein said clog shoe liner having a waterproof outer layer and a soft inner layer;

wherein said outer layer and said soft inner layer having similar shapes and dimensions including a toe portion;

wherein said outer layer and said soft inner layer adhered to each other for providing a unitary structure to said clog shoe liner;

wherein said clog shoe liner having said toe portion and an upper foot covering portion for covering a top portion of the foot of the user;

wherein said upper foot covering portion having at least two studs disposed thereon extending through existing ventilator holes in the existing clog shoe; and a pair of fasteners attached to said at least two studs for securing said clog shoe liner to the clog shoe; and wherein the pair of fasteners are each configured to releasably attach to the respective stud once penetrating the respective existing ventilator holes in the existing clog shoe from the outside of the existing clog shoe; and wherein the thin foam layer is an open cell foam layer.

8. The multipurpose clog shoe liner of claim 7 wherein said clog shoe liner having a heel portion and a footbed, and further wherein said heel portion and said footbed for supporting a foot of a user.

9. The multipurpose clog shoe liner of claim 8, wherein said clog shoe liner covering a majority of the foot of a wearer and lining an entire front area of the clog shoe.

10. The multipurpose clog shoe liner of claim 8, wherein said inner layer having a thin foam layer including a thickness from 1 mm to 3 mm.

11. The multipurpose clog shoe liner of claim 7, wherein said clog shoe liner is washable.

12. A method of lining a clog shoe, the method comprising the steps of:

providing a reusable clog shoe liner;

inserting said reusable clog shoe liner into an existing clog shoe having a plurality of ventilator holes;

wherein said clog shoe liner having a waterproof outer layer and a soft inner layer;

wherein said outer layer and said soft inner layer having similar shapes and dimensions including a toe portion;

wherein said outer layer and said soft inner layer adhered to each other for providing a unitary structure to said clog shoe liner;

wherein said clog shoe liner having said toe portion and an upper foot covering portion for covering a top portion of the foot of the user;

wherein said upper foot covering portion having at least two studs connected thereto;

extending said at least two studs through two of said plurality of ventilator holes; and fastening a pair of fasteners to a portion of said at least two studs that has penetrated the ventilator holes in the existing clog shoe for releasably externally securing said clog shoe liner to the clog shoe; and wherein the inner layer is a memory foam layer.

13. The method of lining a clog shoe of claim 12, wherein said clog shoe liner is comprised of a heel portion and a footbed, and further wherein said heel portion and said footbed for supporting a foot of a user.

14. The method of lining a clog shoe of claim 13, wherein said clog shoe liner covering a majority of the foot of a wearer and lining an entire front area of the clog shoe.

* * * * *